United States Patent [19]

Malafronte

[11] 4,040,625

[45] Aug. 9, 1977

[54] FLYING DISC HANDLING APPARATUS

[76] Inventor: Victor Malafronte, 2910 Newbury St., Berkeley, Calif. 94703

[21] Appl. No.: 761,818

[22] Filed: Jan. 24, 1977

Related U.S. Application Data

[63] Continuation-in-part of Ser. No. 643,537, Jan. 26, 1976, abandoned.

[51] Int. Cl.[2] ..... A63B 67/06

[52] U.S. Cl. ..... 273/104; 46/47

[58] Field of Search ..... 46/47, 74 D; 63/1 R, 63/15; 273/1 R, 95 R, 96 R, 102.4, 105.6, 106 B, 106 R, 104, 98, 105.2, DIG. 17

[56] References Cited

U.S. PATENT DOCUMENTS

| | | | |
|---|---|---|---|
| 1,404,132 | 1/1922 | Manes | 273/106 B |
| 3,036,832 | 5/1962 | Ellman et al. | 273/96 R |
| 3,183,422 | 5/1975 | Ryan | 273/DIG. 17 |
| 3,186,124 | 6/1965 | Voss | 273/104 X |
| 3,409,299 | 11/1968 | Yoneshige | 273/98 |
| 3,901,505 | 8/1975 | Gerechter | 273/DIG. 17 |
| 3,959,989 | 6/1976 | Bhandia | 46/47 X |

FOREIGN PATENT DOCUMENTS

| | | | |
|---|---|---|---|
| 1,283,972 | 1/1962 | France | 273/96 |

*Primary Examiner*—Anton O. Oechsle
*Assistant Examiner*—Vance Y. Hum
*Attorney, Agent, or Firm*—Bruce & McCoy

[57] ABSTRACT

An apparatus for handling toy and sport flying discs including a ring secured to a shaft with a roller rotatably mounted on the shaft to permit a flying disc to continue to spin after it has been caught on the apparatus.

8 Claims, 4 Drawing Figures

FLYING DISC HANDLING APPARATUS

RELATED APPLICATIONS

This application is a continuation-in-part application of Ser. No. 643,537 filed Jan. 26,1976 , now abandoned.

BACKGROUND OF THE INVENTION

1. FIELD OF THE INVENTION

The present invention relates to the field of games and toy and sport apparatus and more particularly to an apparatus for handling flying discs.

2. DESCRIPTION OF THE PRIOR ART

Over the past several, years flying discs resembling saucers have achieved popularity in games of skill. A flying disc can be propelled by a person so that it rotates about its own axis as it travels through the air. The unique aerodynamic characteristics of a flying disc allow skillful throwers to perform many different manuevers with the toy. As a result, throwing and catching these discs has developed into a competitive sport as well as a source of amusement.

Skillful throwers can utilize the aerodynamic properties of flying discs to create new and unusual flight patterns. A thrower can vary the velocity of the disc or its angle of release with respect to the ground or the body, thereby causing the disc to float in a gentle arc, to act as a boomerang, to ricochet off the ground or to travel through the air in other predictably unique flight paths. Throwers can also change the plane of the disc before release or propel it from different body positions to create new and unusual flight patterns.

The catcher of a flying disc, however, is more limited in the tricks he or she can employ to accomplish the catch. The usual method is to grab the moving disc with one's hand or hands before it has hit the ground. The catcher then becomes a thrower by changing hand positions and propelling the disc to the original thrower or to another catcher. One also may attempt to catch the rim of a spinning disc on an extended finger, but this feat is made difficult by the speed and approach pattern of the moving disc.

Skill and enjoyment of the sport are increased when the flying disc can be kept in nearly continual motion between thrower and catcher. If one catches the disc by the usual procedure, he or she will arrest the rotational spin of the moving disc and slow down the momentum of the game. Even if the catcher can successfully engage the disc with one finger to maintain its rotational force, it is still difficult to then throw the flying disc with control to the next recipient.

The present invention overcomes these drawbacks of the flying disc sport and permits the catcher to make unique receptions. When the invention is attached to the finger of the catcher, it enables him or her to catch the edge of the moving flying disc with a minumum of friction. It is thus easier for the catcher to maintain the rotational spin of the disc while transferring it to his or her throwing hand. This characteristic allows the catcher to perform many additional manuevers prior to throwing the disc which are not otherwise possible and enhances the enjoyment and competition of the sport for both the participants and the spectators.

SUMMARY OF THE INVENTION

The present invention is a game apparatus for handling aerodynamic implements and particularly flying discs. It includes a ring to which is secured a protruding shaft. A roller is journaled on the shaft to engage the inside edge of the rim of the flying disc and to permit the disc to continue spinning after it has been caught.

OBJECTS OF THE INVENTION

It is therefore an important object of the present invention to provide a game apparatus which can be used to engage the edge of a moving rotating flying disc.

It is another object of the present invention to provide a device which will minimize friction when it has engaged a moving rotating flying disc.

It is a further object of the present invention to provde a device which will prolong the duration of the spin of a flying disc after it has been engaged by the device.

It is yet another object of the present ivention to provide an apparatus which enables the wearer thereof to engage a moving rotating flying disc and thereafter perform many usual and otherwise extremely difficult manuevers before throwing the disc and to preform such unique maneuvers more consistently and efficiently than otherwise possible.

It is yet a further object of the invention to provide an apparatus which reduces the irritation caused to a person's hand by repeated catching and throwing of a hard plastic flying disc.

It is still a further object of the invention to protect the wearer thereof from injury to his or or her hand when making catches of a flying disc when the disc approaches close to a hard surface.

It is still another object of the invention to provide an apparatus which will rotatably support a spinning flying disc.

Other objects and advantages of the invention will become apparent when it is considered in conjunction with the accompanying drawings described hereafter.

DESCRIPTION OF THE PREFERRED EMBODIMENT

Figure 1:
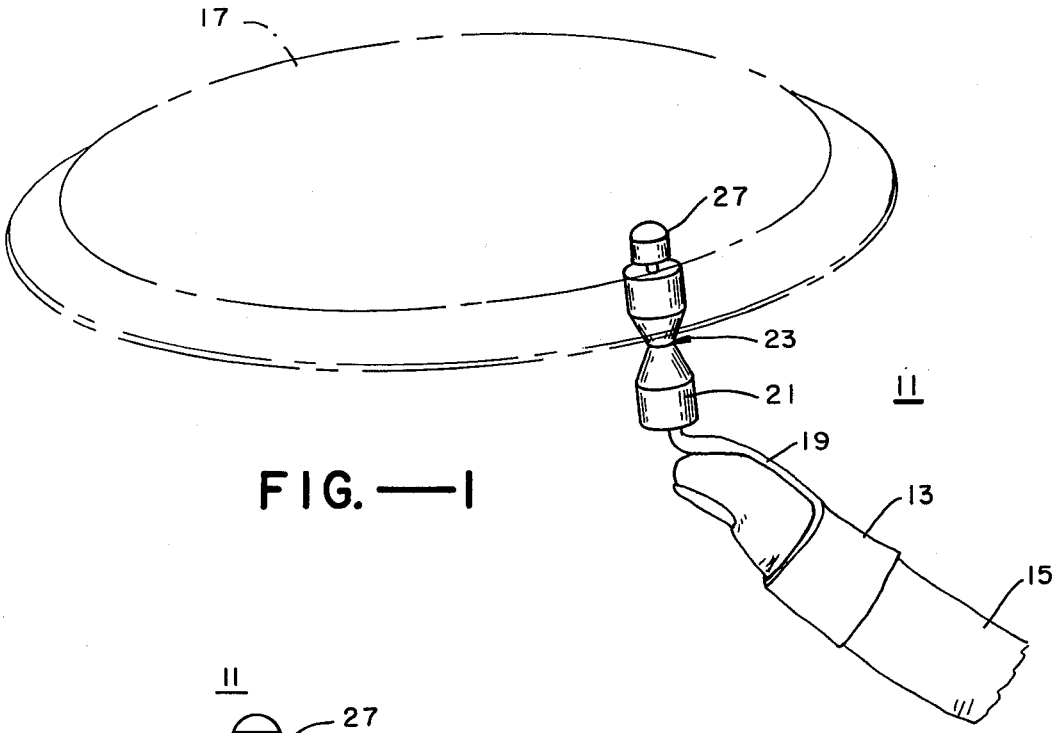
FIG. 1, is a perspective view of a flying disc handling apparatus, illustrates the invention disposed on the finger of a weaver and engaging the underside of a flying disc.

The present invention is a flying disc handling apparatus 11 which includes a ring member 13 arranged for wearing on the finger 15 of a player. The ring member may be either of a fixed configuration and size or and adjustable type to fit fingers of different sizes. The ring member may be made from metal, teflon, plastic or the like. It may be worn on a finger of either hand of the catcher but it is frequently placed on the index or middle finger of the non-throwing hand of the player to permit him or her to catch the flying disc 17 and transfer it to the other hand while it is stil rotating.

A shaft 19 is secured to the ring member 13 and projects therefrom to extend from the end of the user's finger 15 In the preferred embodiment, a bottom portion of the shaft, extending from the ring to the tip of the finger, is flat and fitted to the surface thereof. A small bearing or bearing surface may be located on the shaft to facilitate rotation of a roller element 21 thereon. The upper portion of the shaft beginning at the end of the finger has a circular cross-section and projects outwardly from the tip of the finger at an oblique angle. The shaft member may be a thin circular pole which is attached to the ribg member by any appropriate means, for example, by a flat metal strip which is secured to the ring at one end and at the other end thereof.

Figure 3:
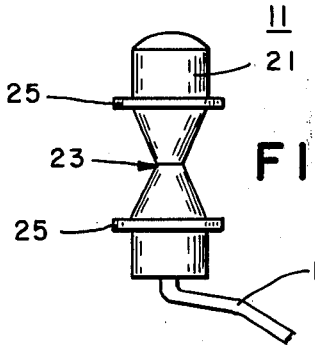
FIG. 3 is a partial side elevational view of another embodiment of the present invention.
Figure 4:
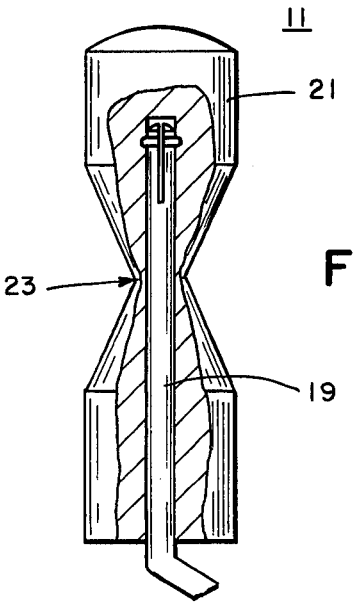
FIG. 4 shows a partial enlarged cut-away view of yet another embodiment of the apparatus.

A roller 21 is journalled on the shaft 19; the external configuration of the roller being formed for engaging the inside edge of the rim of a flying disc 17 and thereby permitting the disc to continue spining after it has been caught by the player on the apparatus. This roller is mounted on the shaft so that it rotates around the axis thereof when it engages the edge of a spinning flying disc. The roller may be made of metal or hard plastic or it may be formed from teflon or any other material which would enhance its free rotation without use of bearings or bearing surfaces. In the embodiments shown in FIGS. 1, 2 and 4, the roller has a generally elongated shape with smooth surfaces. The roller is disposed at the end of the projecting shaft and may have either a rounded tip as illustrated in FIGS. 3 and 4 to engage the underside of a flying disc with a minimum of friction, or a tip with a flat smooth surface for rotatably supporting a spinning flying disc (not shown).

The roller 21 could have straight sides or sides of just about any shape, but preferably has an external configuration which includes a groove 23 running around the axis of rotation of the roller. This groove is an indentation or recess which may be formed into various shapes, such as a V-shaped or U-shaped groove, and of different depths. The groove which is generally disposed mid-length of the roller is formed to engage the inside edge of the rim of a flying disc 17. A plane intersecting the point where the two sides of a V- shaped groove meet would be substantially perpendicular to the shaft 19. The continuous groove is located on the roller in a position so that the underside rim of a flying disc will be engaged therewith to prevent the spinning disc from slipping off the end of the roller. The roller may also have rounded top and bottm surfaces and a groove formed in the approximate mid-point of the roller which causes it to resemble a dumbbell.

In another preferred embodiment of the present invention, a continuous flange 25 may be disposed on the surface of the roler 21 to engage the rim of a flying disc in the same fasion as the groove 23. The flange is perpendicular to the axis of rotation of the roller and is located generaly at the mid-point of the roller. In an alternative embodiment illustrated by FIG. 3, two parallel flanges are disposed on the roller at each end of a groove in the roller.

Figure 2:
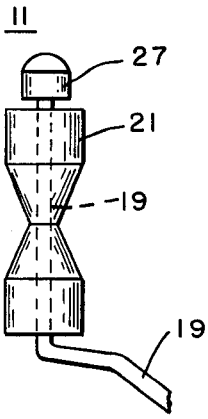
FIG. 2 is a partial side elevational view of the embodiment of the present invention shown in FIG. 1.

A further embodiment of the present invention shown in FIGS. 1 and 2 includes a rounded fixed cap 27 secured to the end of the projecting shaft 19 with the roller 21 journalled on the shaft between the base and the cap. This cap, which may have a flat surface and smooth rounded edges, acts as a stabilizer to the flying disc. The fixed cap has a smooth bottom surface which is parallel to the top surface of the generally cylindrical roller such that the roller rotates along the axis of the shaft with the minimum of friction between it and the cap. This cap enables one to construct this embodiment of the present invention relatively easily from performed or standard elements.

The main advantage of the present invention is to enhance the enjoyment and competition of the flying disc sport. The embodiments of the present invention allow a catcher wearing the apparatus on his or her hand to engage a moving flying disc with a minimum of friction. The duration of spin of the flying disc is prolonged while the disc is in contact with the invention. This enables the catcher to perform many unique manuevers before throwing the disc to the next participant. For instance, the disc can be transferred under one's leg, behind one's back, or across one's body to the other hand by the skillful use of the present invention. Many other unusual maneuvers are made possible or can be performed more consistently by the use of this invention.

It will be seen that the above described apparatus will achieve all the advantages and objects attributed to it, and while it has been described in detail, it is no to be limited to such details except as may be necessitated by the appended claims.

I claim:

1. Game apparatus for use in flying disc sports, said apparatus comprising an adjustable ring;

a shaft;

means for attaching said shaft to said adjustable ring; and a roller mounted on said shaft and having a rounded tip to catch the trailing edge of the flying disc in midair, said roller rotating along the axis of the shaft to minimize friction between said adjustable ring and the rim of said flying disc thus prolonged the duration of spin of said flying disc after it has been caught by adjustable ring.

2. The apparatus of claim 1 wherein a V-shaped groove is formed on said roller, said groove running entirely around the approximate midpoint of said roller in the direction of its rotation and being perpendicular to the shaft for containing the trailing edge of the disc as it spins on the ring.

3. The apparatus of claim 1 wherein the tip of the rotatable roller has a flat smooth surface for rotatably supporting a spining flying disc.

4. A flying disc handling apparatus comprising a ring member arranged for wearing on the finger of the player;

a shaft secured to said ring member and projecting therefrom to extend from the end of the player's finger; and a roller journalled on said shaft, said roller having an external configuration formed for engaging the inside edge of the rim of the flying disc and to permit the disc to continue spinning after it has been caught by the player on the apparatus.

5. The flying disc handling apparatus of claim 4 wherein the end of said roller disposed at the end of said projecting shaft is rounded for engaging the underside of the flying disc with the least possible friction.

6. The flying disc handling apparatus of claim 5 wherein the external configuration of said roller includes a groove running around the axis of rotation of said roller and which engages the rim of the disc.

7. The flying disc handling apparatus of claim 4 wherein at least one continuous flange is disposed on the roller perpendicular to its axis of rotation for engaging the rim of a flying disc.

8. The flying disc handling apparatus of claim 4 wherein said shaft includes a rounded fixed cap secured to the end thereof and said roller includes a groove formed in the external surface thereof running around the axis of rotation of said roller and which engages the rim of the disc.

* * * * *